US010349790B2

(12) United States Patent
Fulscher et al.

(10) Patent No.: US 10,349,790 B2
(45) Date of Patent: Jul. 16, 2019

(54) REFILLABLE, FLEXIBLE DISPENSER WITH HANDLE FOR STACKED MOIST WIPES

(71) Applicant: Kimberly-Clark Worldwide, Inc., Neenah, WI (US)

(72) Inventors: Ryan Leslie Fulscher, Neenah, WI (US); Karen Marie Menard, Neenah, WI (US); Kam Mei Li, Yuen Long (CN)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1004 days.

(21) Appl. No.: 14/170,056

(22) Filed: Jan. 31, 2014

(65) Prior Publication Data

US 2015/0216378 A1 Aug. 6, 2015

(51) Int. Cl.
*A47K 10/42* (2006.01)
*A47K 10/32* (2006.01)

(52) U.S. Cl.
CPC ..... *A47K 10/421* (2013.01); *A47K 10/42* (2013.01); *A47K 2010/3233* (2013.01); *A47K 2010/3266* (2013.01)

(58) Field of Classification Search
None
See application file for complete search history.

(56) References Cited

U.S. PATENT DOCUMENTS 2,704,183 A 3/1955 Stern
3,054,434 A 9/1962 Steven et al.
3,160,337 A 12/1964 Nelson
3,328,854 A * 7/1967 Tombari ..... 16/2.1
3,473,694 A 10/1969 Murphy et al.
(Continued)

FOREIGN PATENT DOCUMENTS

EP 1 388 503 A1 2/2004
EP 1 317 202 B1 11/2006
(Continued)

OTHER PUBLICATIONS

Co-pending U.S. Appl. No. 13/921,851, filed June 19, 2013, by Bechyne et al. for "Refillable, Flexible Dispenserfor Stacked Moist Wipes."

(Continued)

*Primary Examiner* — Gene O Crawford
*Assistant Examiner* — Kelvin L Randall, Jr.
(74) *Attorney, Agent, or Firm* — Kimberly-Clark Worldwide, Inc.

(57) ABSTRACT

A refillable dispenser for pre-moistened wipes includes a flexible pouch. The pouch has a front wall, a back wall, and an interior space therebetween. A dispensing opening is formed in the front wall, and a movable cover can cover the dispensing opening. The dispenser includes a seam that can be opened to an open position and resealed to a closed position to connect the front wall to the back wall. The open position defines a refill opening. The dispenser includes a front wall eyelet extending through the front wall and a back wall eyelet extending through the back wall, and the front wall eyelet is superposed over the back wall eyelet. The dispenser includes a handle connected to the pouch via a handle connector. The handle connector extends through the front wall eyelet and the back wall eyelet.

18 Claims, 9 Drawing Sheets

(56) References Cited

U.S. PATENT DOCUMENTS

| | | | | |
|---|---|---|---|---|
| 3,826,407 | A | 7/1974 | Keating | |
| 3,942,682 | A | 3/1976 | McKay | |
| 3,982,659 | A | 9/1976 | Ross | |
| 4,156,493 | A | 5/1979 | Julius | |
| 4,185,754 | A | 1/1980 | Julius | |
| 4,252,238 | A | 2/1981 | Spiegelberg et al. | |
| 4,570,820 | A | 2/1986 | Murphy | |
| 4,706,844 | A | 11/1987 | Omdoll et al. | |
| 4,979,613 | A | 12/1990 | McLaughlin et al. | |
| 5,127,545 | A | 7/1992 | French | |
| 5,465,888 | A | 11/1995 | Owens | |
| 5,647,107 | A * | 7/1997 | Brewster | 24/713.6 |
| 5,788,378 | A | 8/1998 | Thomas | |
| 5,967,321 | A | 10/1999 | Sigl | |
| 6,053,357 | A | 4/2000 | Yoh | |
| 6,126,317 | A | 10/2000 | Anderson et al. | |
| 6,164,442 | A | 12/2000 | Stravitz | |
| 6,224,258 | B1 * | 5/2001 | Dodson | 383/9 |
| 6,234,676 | B1 | 5/2001 | Galomb et al. | |
| 6,427,839 | B1 | 8/2002 | Helfer-Grand | |
| 6,523,690 | B1 | 2/2003 | Buck et al. | |
| 6,533,456 | B1 | 3/2003 | Buchman | |
| 6,550,635 | B1 * | 4/2003 | King et al. | 221/49 |
| 6,578,731 | B1 * | 6/2003 | Lewis et al. | 221/46 |
| 6,609,616 | B2 | 8/2003 | Dilnik et al. | |
| 6,702,109 | B1 | 3/2004 | Tabuchi | |
| 6,758,369 | B2 | 7/2004 | Morin et al. | |
| 6,766,919 | B2 | 7/2004 | Huang et al. | |
| 6,817,484 | B2 | 11/2004 | Morin et al. | |
| 6,840,401 | B2 | 1/2005 | Amundson | |
| 6,959,834 | B2 | 11/2005 | McDonald | |
| 7,059,493 | B2 | 6/2006 | Welchel et al. | |
| 7,140,492 | B2 | 11/2006 | Julius | |
| 7,172,093 | B2 | 2/2007 | Bando | |
| 7,192,191 | B2 | 3/2007 | Wedi et al. | |
| 7,273,156 | B2 | 9/2007 | Gao et al. | |
| 7,303,092 | B2 | 12/2007 | Sarbo et al. | |
| 7,320,545 | B2 | 1/2008 | Strand et al. | |
| 7,416,083 | B2 * | 8/2008 | Bando | 206/494 |
| D582,152 | S | 12/2008 | Rappaport et al. | |
| 7,530,471 | B2 | 5/2009 | Cohen et al. | |
| 7,549,800 | B2 | 6/2009 | Ajootian | |
| 7,614,519 | B2 | 11/2009 | Krauth et al. | |
| 7,621,401 | B2 | 11/2009 | Alegre de Miguel et al. | |
| 7,699,166 | B2 | 4/2010 | Gauger et al. | |
| 7,699,189 | B2 | 4/2010 | Tramontina | |
| 7,735,682 | B1 | 6/2010 | Cassel et al. | |
| 8,002,115 | B2 | 8/2011 | Rappaport et al. | |
| 8,016,155 | B2 | 9/2011 | Decker et al. | |
| 8,033,421 | B2 | 10/2011 | Cowell et al. | |
| 8,066,118 | B1 | 11/2011 | Van Tassell | |
| 8,083,660 | B2 | 12/2011 | Chaturvedi | |
| 8,132,395 | B2 | 3/2012 | Gehring et al. | |
| 8,142,077 | B2 | 3/2012 | Iannelli, II et al. | |
| 8,220,659 | B2 | 7/2012 | Beuther | |
| D671,000 | S | 11/2012 | O'Neill et al. | |
| 8,496,106 | B1 * | 7/2013 | Bigg | 206/38 |
| 2001/0038016 | A1 | 11/2001 | Russo | |
| 2002/0084279 | A1 | 7/2002 | Lickstein | |
| 2002/0096534 | A1 | 7/2002 | Amundson et al. | |
| 2002/0108962 | A1 | 8/2002 | Mangin | |
| 2003/0024919 | A1 | 2/2003 | Julius | |
| 2003/0213810 | A1 | 11/2003 | Wu | |
| 2004/0058103 | A1 | 3/2004 | Anderson et al. | |
| 2004/0173492 | A1 | 9/2004 | Kane et al. | |
| 2004/0203306 | A1 | 10/2004 | Grafe et al. | |
| 2005/0258062 | A1 | 11/2005 | Bando | |
| 2005/0263226 | A1 | 12/2005 | Smithers | |
| 2005/0279756 | A1 | 12/2005 | Bitowft et al. | |
| 2006/0086627 | A1 | 4/2006 | Saggar et al. | |
| 2006/0138159 | A1 | 6/2006 | Altuve et al. | |
| 2006/0151518 | A1 * | 7/2006 | Sarbo et al. | 221/63 |
| 2007/0181592 | A1 * | 8/2007 | Prevo | 221/48 |
| 2007/0241124 | A1 | 10/2007 | Buck et al. | |
| 2008/0044110 | A1 | 2/2008 | Garger | |
| 2008/0253697 | A1 | 10/2008 | O'Neill et al. | |
| 2009/0014459 | A1 | 1/2009 | Hood et al. | |
| 2009/0046956 | A1 | 2/2009 | Redzisz et al. | |
| 2010/0001015 | A1 * | 1/2010 | Thoren et al. | 221/30 |
| 2010/0001016 | A1 | 1/2010 | Savage | |
| 2010/0072224 | A1 | 3/2010 | Ha | |
| 2010/0155272 | A1 | 6/2010 | Ottman et al. | |
| 2011/0005943 | A1 | 1/2011 | Beihoffer et al. | |
| 2011/0073225 | A1 | 3/2011 | Pace et al. | |
| 2011/0079603 | A1 | 4/2011 | Gordon | |
| 2011/0232811 | A1 | 9/2011 | Gonzalez | |
| 2011/0249919 | A1 | 10/2011 | Shepard | |
| 2011/0315707 | A1 | 12/2011 | Kleinhuber | |
| 2012/0032565 | A1 | 2/2012 | Stoeoep et al. | |
| 2012/0048858 | A1 | 3/2012 | Peters et al. | |
| 2012/0097697 | A1 * | 4/2012 | Gehring | 221/46 |
| 2012/0099808 | A1 | 4/2012 | Washington | |
| 2012/0145706 | A1 | 6/2012 | Martin | |
| 2012/0267403 | A1 * | 10/2012 | Ward, Jr. | 224/219 |
| 2012/0273541 | A1 * | 11/2012 | Zwach | 224/615 |
| 2013/0032608 | A1 | 2/2013 | McCloskey | |
| 2013/0213989 | A1 | 8/2013 | Kimple et al. | |
| 2014/0076918 | A1 * | 3/2014 | Hailey et al. | 221/45 |

FOREIGN PATENT DOCUMENTS

| | | | |
|---|---|---|---|
| EP | 1 862 396 | B1 | 3/2011 |
| FR | 2 376 802 | A1 | 8/1978 |
| GB | 793745 | A | 4/1958 |
| GB | 1 324 512 | A | 7/1973 |
| GB | 2 413 483 | A | 11/2005 |
| GB | 2 425 717 | B | 3/2007 |
| GB | 2 459 294 | A | 10/2009 |
| JP | 2000-072160 | A | 3/2000 |
| JP | 2005-082192 | A | 3/2005 |
| JP | 3826496 | B2 | 9/2006 |
| JP | 3981753 | B2 | 9/2007 |
| KR | 20-2010-0008081 | U | 8/2010 |
| NL | 1021446 | C1 | 3/2004 |
| TW | M 364686 | Y | 9/2009 |
| WO | WO 2000/064755 | A2 | 11/2000 |
| WO | WO 2009/126081 | A1 | 10/2009 |

OTHER PUBLICATIONS

Co-pending U.S. Appl. No. 13/921,896, filed June 19, 2013, by Thoresen et al. for "Refillable, Flexible Moist Wipes Dispenser Having Offset Dispensing Orifice."

* cited by examiner

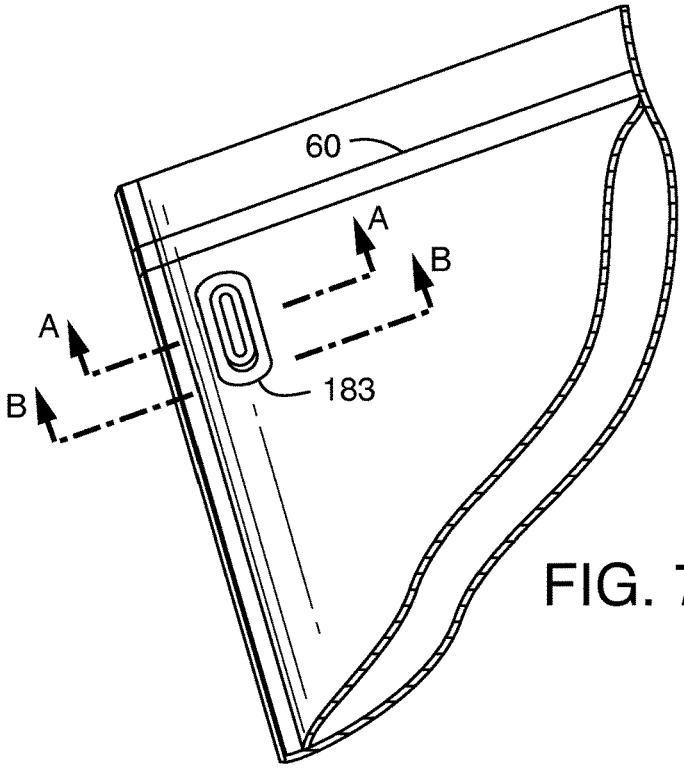
FIG. 7
FIG. 8
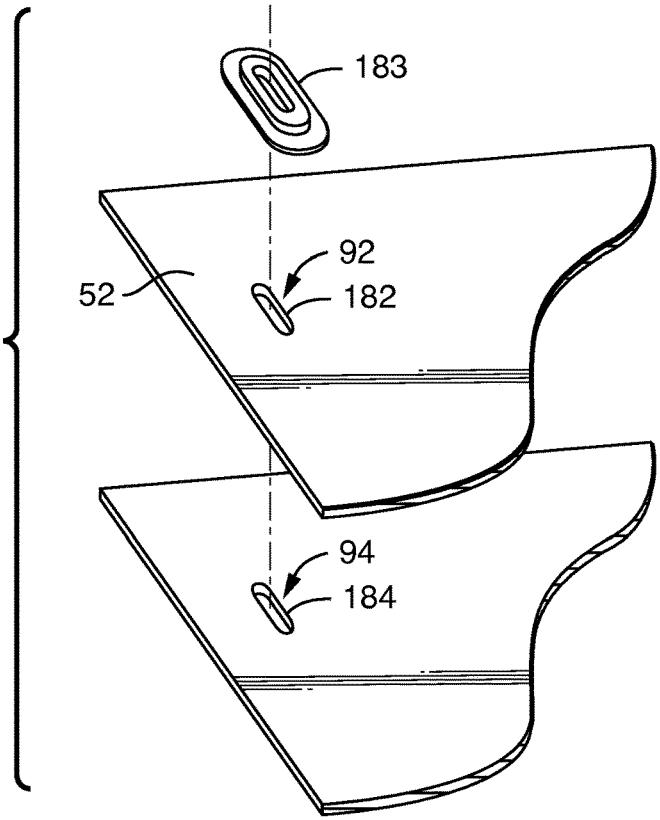

REFILLABLE, FLEXIBLE DISPENSER WITH HANDLE FOR STACKED MOIST WIPES

BACKGROUND OF THE INVENTION

There are a variety of storing and dispensing containers in the market, particularly those for storing and dispensing wipe-type products. Wipe-type products or wipes have been made from a variety of materials which can be dry or wet when used. Wet wipes can be moistened with a variety of suitable wiping solutions. Typically, wet wipes have been stacked in a container in either a folded or unfolded configuration. For example, containers of wet wipes have been available wherein each of the wet wipes stacked in the container has been arranged in a folded configuration such as a c-folded, z-folded or quarter-folded configuration as are well known to those skilled in the art. Sometimes each folded wet wipe is interfolded with the wet wipes immediately above and below it in the stack of wipes. In an alternative configuration, the wet wipes have been placed in a container in the form of a continuous web of material that includes perforations adapted to allow for separation of individual wet wipes from the web upon the application of a pulling force. Such wet wipes have been used for baby wipes, hand wipes, personal care wipes, household cleaning wipes, industrial wipes and the like.

Conventional wipes dispensers may be classified into two categories: (1) relatively stiff, durable tubs that are relatively large, are designed to be refilled, and that do not change in volume as wipes are removed; and (2) rigid "flip-top" packages that are made of highly flexible, plastic film material and that shrink in volume as wipes are removed, but that are not refillable. What is needed in the art is a wipes dispenser that in particular embodiments does not possess the enormity and rigidity of common baby wipes "tubs"; is refillable; that shrinks in volume as wipes are removed; that dispenses wipes efficiently; and that includes a carrying handle that is firmly secured to the wipes compartment in a way that does not degrade the moisture imperviousness of the wipes compartment.

SUMMARY OF THE INVENTION

In one embodiment of the invention, the refillable dispenser for pre-moistened wipes defines a length dimension and a transverse width dimension. The dispenser has a top and a bottom spaced apart in the transverse width dimension. The dispenser includes a flexible pouch. The pouch has a front wall and a back wall. The front wall has a front wall periphery, and the back wall has a back wall periphery. The front and back walls are connected to each other along their respective peripheries to define a substantially moisture impervious interior space sandwiched therebetween. The dispenser includes a dispensing opening formed in the front wall, and in particular embodiments includes a movable cover adapted to cover the dispensing opening. The dispenser includes a seam that can be opened to an open position and resealed to a closed position to connect the front wall to the back wall. The open position is configured to define a refill opening. The dispenser includes a front wall eyelet extending through the front wall and a back wall eyelet extending through the back wall, and the front wall eyelet is superposed over the back wall eyelet. Both the front wall eyelet and the back wall eyelet are disposed transversely inward of the seam. The dispenser includes a handle connected to the pouch via a handle connector. The handle connector extends through the front wall eyelet and the back wall eyelet.

BRIEF DESCRIPTION OF THE DRAWINGS

FIG. 7 is front perspective view of a portion of the dispenser of FIG. 6 but with the handle omitted.

FIG. 8 is an exploded perspective view of the dispenser portion of FIG. 7.

DETAILED DESCRIPTION OF PARTICULAR EMBODIMENTS

Figure 1:
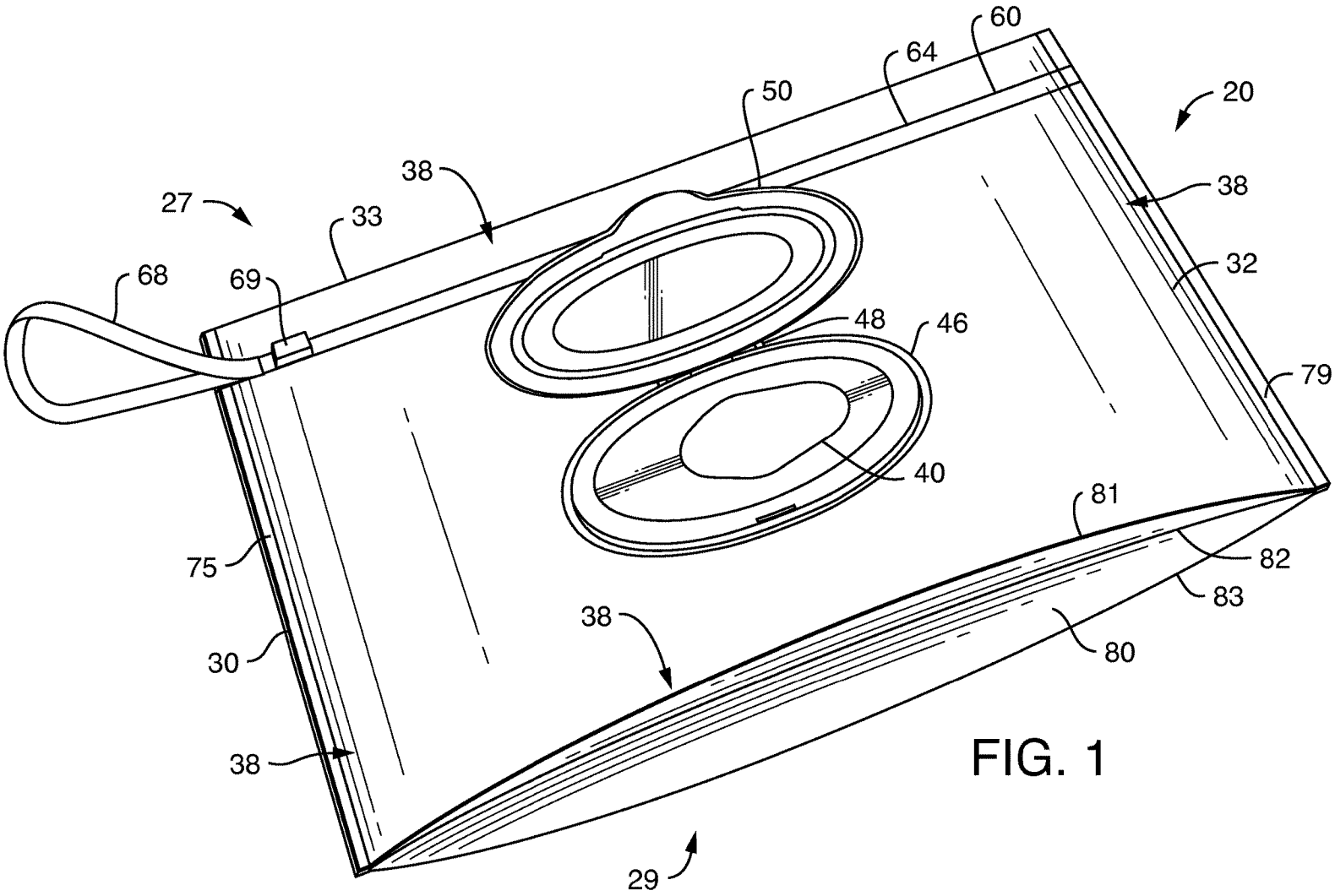
FIG. 1 is a front perspective view of one embodiment of a dispenser suitable for use in conjunction with the present invention.

In particular embodiments, a refillable dispenser 20 houses a stack 22 of pre-moistened or wet wipes, such as diapering wipes, toileting wipes, feminine care wipes, or other wipes known in the art. The dispenser defines a length dimension 21 and a transverse width dimension 23. The dispenser 20 comprises a flexible pouch 30 that has a top 27 and a bottom 29 spaced apart from each other in the width dimension 23. The top 27 terminates at a top edge 33 and the bottom 29 terminates at a bottom edge 35. The pouch 30 has a front wall 32, a back wall 34, and an interior space 36 between the front wall 32 and the back wall 34.

Figure 3:
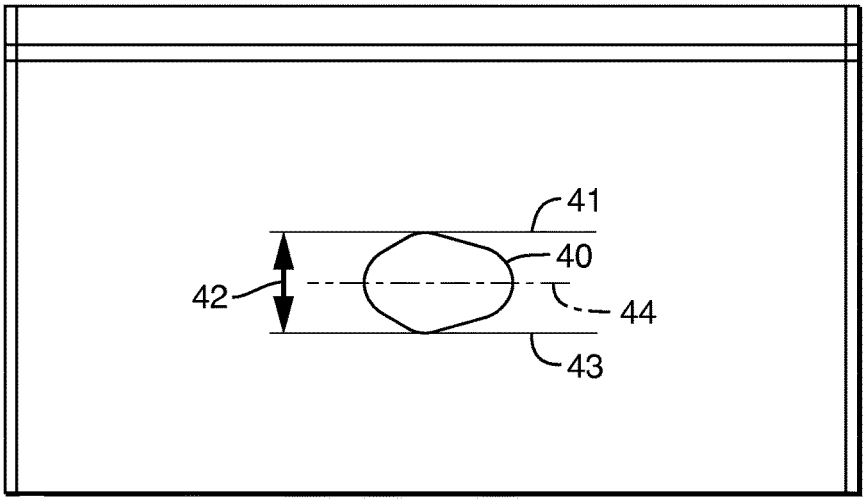
FIG. 3 is a front view of an alternative embodiment of a dispenser suitable for use in conjunction with the present invention, with the cover assembly not present.
Figure 4:
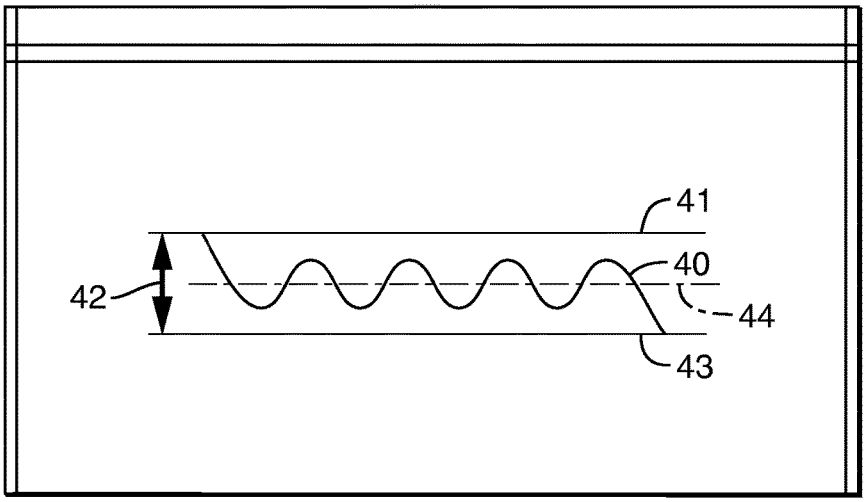
FIG. 4 is a front view of another alternative embodiment of a dispenser suitable for use in conjunction with the present invention, with the cover assembly not present.
Figure 5:
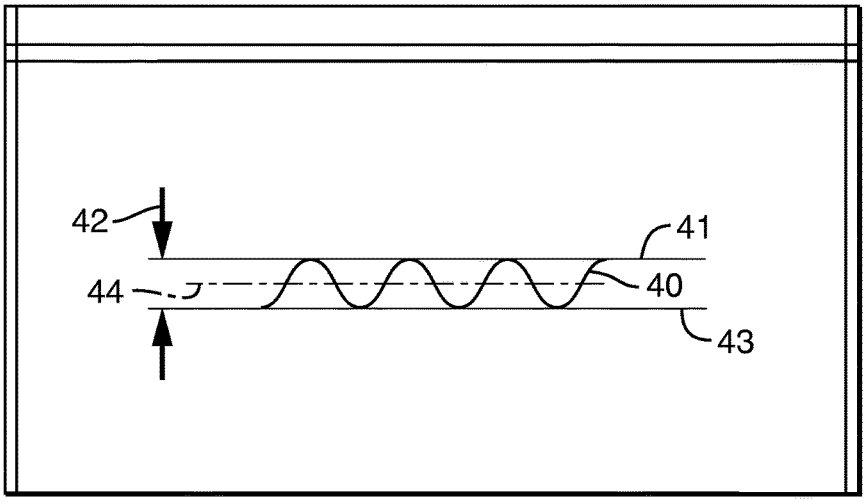
FIG. 5 is a front view of still another alternative embodiment of a dispenser suitable for use in conjunction with the present invention, with the cover assembly not present.

The dispenser further includes a dispensing opening 40 formed in the front wall 32. The dispensing opening 40 can be a hole (FIGS. 1-3), a slit (FIGS. 4-5), or other opening through which a moist wipe can suitably be dispensed. In particular embodiments, the dispensing opening 40 has a dispensing opening width 42 that extends in the width dimension 23. As representatively illustrated in FIGS. 3-5, the dispensing opening width 42 is defined as the distance in the width dimension 23 between a first imaginary line 41 that passes through the point of the dispensing opening 40 that is closest to the top 27 and a second imaginary line 43 that passes through the point of the dispensing opening 40 that is closest to the bottom 29. The dispensing opening 40 defines a midpoint 44 spaced halfway along its width 42.

The dispenser 20 further in particular embodiments includes a movable cover 50 adapted to cover the dispensing opening 40 to help keep the moist wipes from drying out between uses. In particular embodiments, the dispensing opening 40 is surrounded by a rigid ring 46, and the cover 50 is hingedly attached to the ring 46 via a hinge 48.

The dispenser includes a seam 60 that extends generally in the length dimension 21. The seam is located generally at the pouch top 32. The seam 60 can be opened to an open position 62 and resealed to a closed position 64. In the closed position 64, the seam 60 connects the front wall 32 to the back wall 34, either directly, or indirectly by way of intermediate materials. The open position 62 is configured to define a refill opening 66. The refill opening 66 allows a user to replenish the wipe supply into the interior space 36. The seam 60 defines a seam inner edge 61 distal to the top edge 33, and the seam defines a seam outer edge 63 proximal to the top edge 33. Although the seam 60 may include a single or multiple strips or lanes along which the front wall 32 is connected to the back wall, the seam 60 as a whole has only one seam inner edge (namely, the innermost edge of the seam, relatively distal to the top edge 33) and has only one seam outer edge (namely, the outermost seam of the edge, relatively proximal to the top edge 33). In particular embodiments, the seam 60 is a press and seal seam, and/or can include a sliding zipper 69.

In particular embodiments, the front wall 32 and the back wall 34 are each formed from a flexible material having a bending resistance of between 21.0 milligrams of force and about 300 milligrams of force. As used herein, "bending resistance" means the bending resistance as measured in accordance with the protocol outlined below. In particular embodiments, the flexible material has a bending resistance of between 21.0 milligrams of force and 150 milligrams of force, more particularly between about 40 milligrams of force and 150 milligrams of force, more particularly between about 40 milligrams of force and 125 milligrams of force, more particularly between about 40 milligrams of force and 100 grams, more particularly between about 60 milligrams of force and about 100 milligrams of force, and more particularly between about 60 milligrams of force and about 90 milligrams of force. It has been discovered that by constructing the front wall 32 and back wall 34 of such materials, the pouch 30 is durable, is perceived as being high in quality, is efficiently processable, is reasonable in cost, in particular embodiments exhibit minimal "crinkling" noise as it is manipulated, and is flexible enough to bend to fit into a purse, diaper bag, or similar container, and will, furthermore, become thinner/shrink in volume as the wipe supply is depleted.

In particular embodiments, the front wall 32 and the back wall 34 are each formed from a flexible material that has a thickness of at least 5.0 mils (0.127 mm), more particularly at least about 8 mils (0.203 mm), and still more particularly between about 8 mils (0.203 mm) and about 15 mils (0.381 mm). As used herein, "thickness" means the thickness as measured in accordance with the protocol outlined below. Materials having the bending resistance and thickness features described above are described in the Examples below.

In conventional moist wipes dispensers, the dispensing orifice is centered over the interior space of the container or package in both length and width directions. While developing particular aspects of the present invention, it was discovered, in a pouch sized for a stack of wipes having a given length and width, that if the wipes stack was positioned too close to the seam 60, the front wall 32 and back wall 34 pinched the stack of wipes, and thereby negatively impacted dispensing. It was discovered that by offsetting the dispensing opening toward the bottom edge 35 of the pouch 30, this pinching problem could be minimized.

Accordingly, in particular embodiments, the midpoint 44 of the dispensing opening 40 is disposed closer to the bottom edge 35 than to the seam inner edge 61. In particular embodiments, the midpoint 44 of the dispensing opening 40 is disposed at least 5 millimeters closer, more particularly at least 10 millimeters closer, and still more particularly at least 15 millimeters closer to the bottom edge 35 than to the seam inner edge 61.

Figure 2:
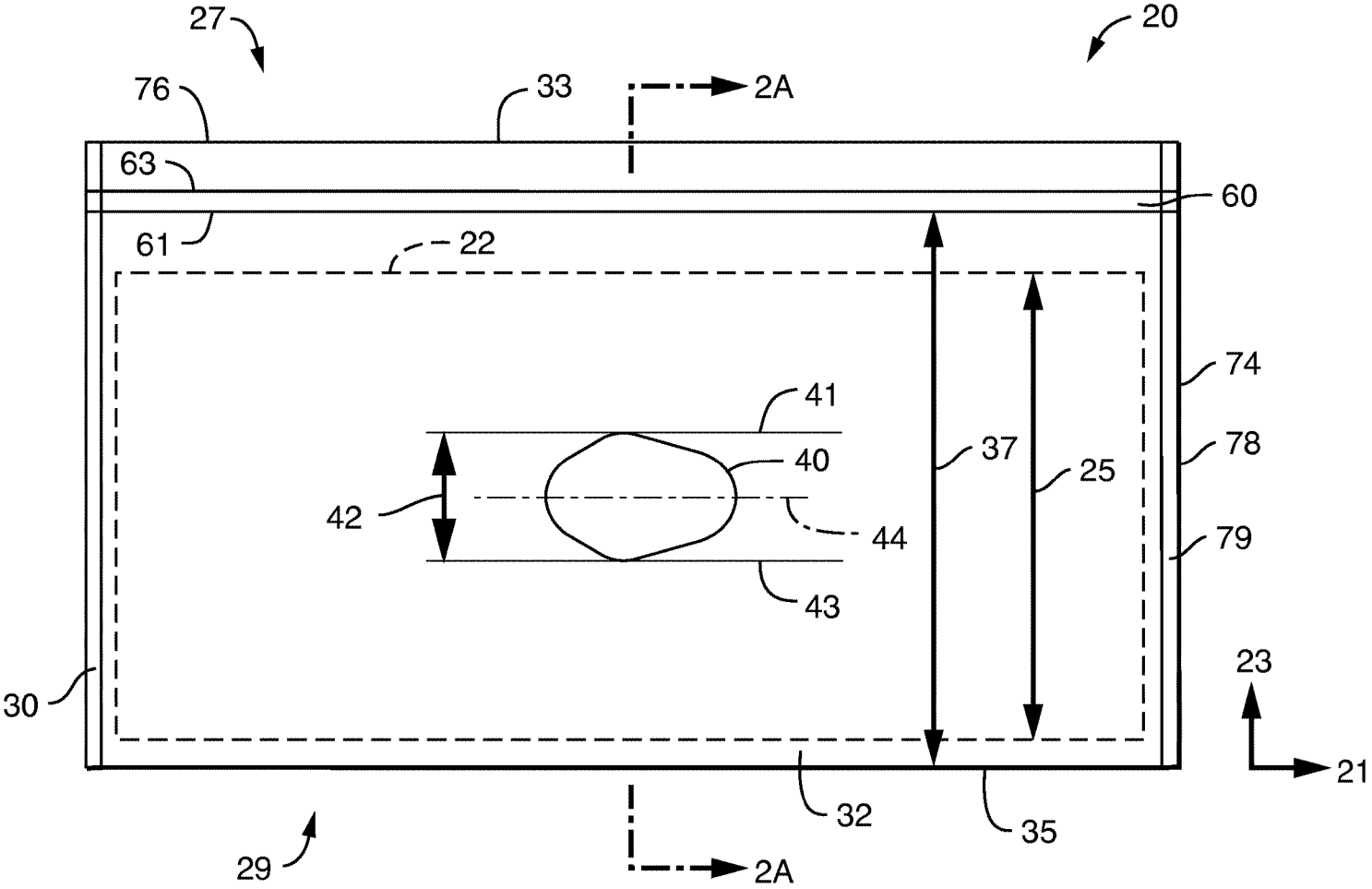
FIG. 2 is a front view of one embodiment of a dispenser suitable for use in conjunction with the present invention, with the cover assembly not present.
Figure 2A:
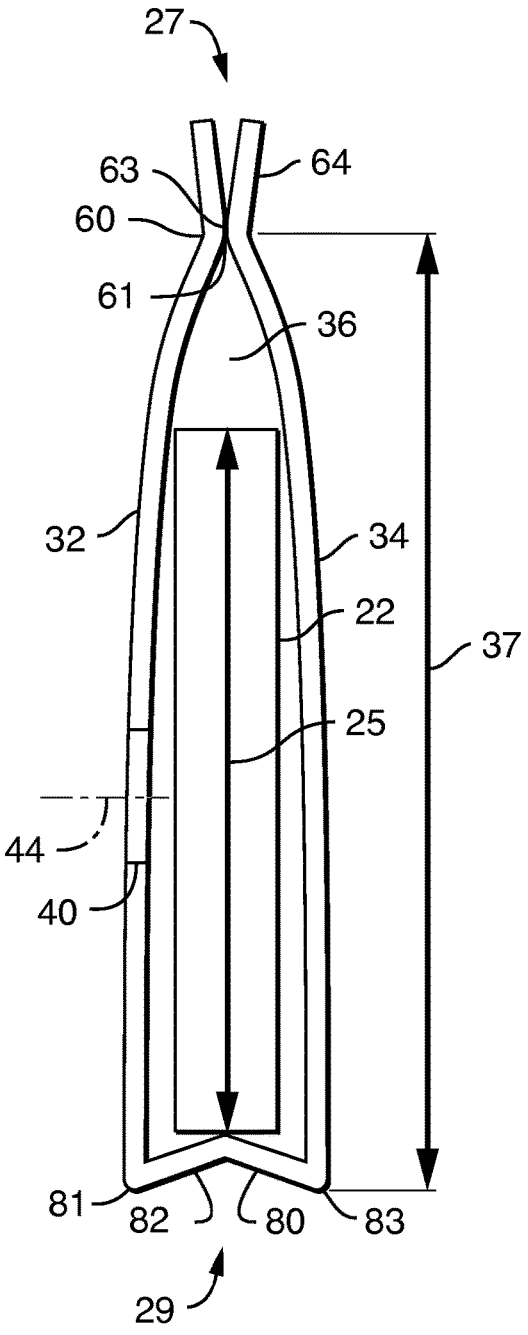
FIG. 2A is a cross-sectional view of the dispenser of FIG. 2 taken along line 2A-2A, the refill opening shown in a closed position.
Figure 2B:
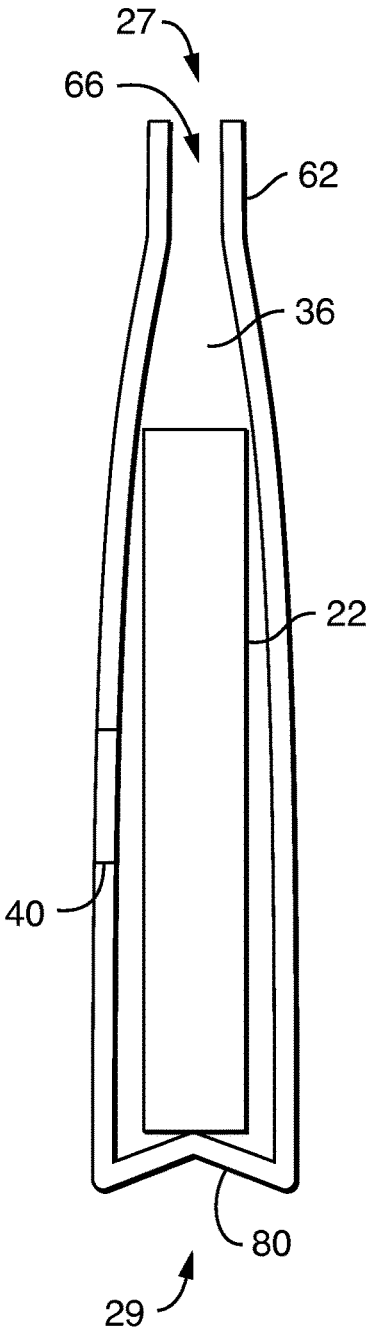
FIG. 2B is a cross-sectional view of the dispenser of FIG. 2 taken along line 2A-2A, but with the refill opening shown in an open position.

Referring to FIGS. 2 and 2A, in particular embodiments, the dispenser includes a stack 22 of pre-moistened wipes. The stack has a stack width 25 that extends in the width dimension 23. The interior space 36 defines an interior space width 37 that extends from the seam inner edge 61 to the bottom edge 35. (For ease of measurement, the interior space width 37 is intentionally described and illustrated as including the thickness of the bottom wall 80, and should be measured as such for purposes herein.) In particular embodiments, the stack width 25 is X % of the interior space width 37, wherein X is at most 90, and the midpoint 44 of the dispensing opening 40 is disposed closer to the bottom edge 35 than to the seam inner edge 61 by an amount of approximately (100−x) % of the interior space width 37. For example, if the interior space width 37 is 10 centimeters and the stack width is 8 centimeters, the stack width 25 is 80% of the interior space width 37, and the midpoint 44 of the dispensing opening 40 is disposed closer to the bottom edge 35 than to the seam inner edge 61 by 20% of the interior space width 37—that is, by approximately 2 centimeters. Thus, the midpoint 44 of the opening 40 would in this example be positioned 4 centimeters from the bottom edge 35, and 6 centimeters from the seam inner edge 61.

In particular embodiments, the front wall 32 has a front wall periphery 38 and the back wall has a back wall periphery 39. The front and back walls 38, 39 are connected to each other along their respective peripheries 38, 39 to define a substantially moisture impervious interior space 36 sandwiched between the front wall 32 and the back wall 34. For example, in particular embodiments of the pouch 30, the front wall 32 has a top edge 72 and first and second side edges 73, 74 that extend perpendicularly from opposite ends of the front wall top edge 72. Similarly, the back wall 34 has a top edge 76 and first and second side edges 77, 78 that extend perpendicularly from opposite ends of the back wall top edge 76. In particular embodiments, the front wall 32 is connected to the back wall 34 via a first side seam 75 that connects the front wall first side edge 73 to the back wall first side edge 77, as well as a second side seam 79 that connects the front wall second side edge 74 to the back wall second side edge 78. The front wall 32 is further connected to the back wall 34 by a bottom gusset wall 80 that can extend between and be formed integrally with the front wall 32 and the back wall 34. For example, in one embodiment, the front wall 32, the back wall 34, and the bottom gusset wall 80 are all integrally formed from a single sheet of flexible material that is configured in an M-fold. The M-fold defines three fold lines 81, 82, 83 that extend in the length dimension 21. The M-fold is held permanently in place at the first side seam 75 and the second side seam 79.

In particular embodiments, a handle 68 can be attached to the pouch 30, such as at the pouch top 27. In one embodiment, the handle 68 can be attached to the sliding zipper 69, as representatively illustrated in FIG. 1. The handle can be a strap (as representatively illustrated in FIGS. 1, 6, and 12), a string, a rope, a chain, or other suitable structure. In particular embodiments, the handle 68 defines a closed loop. A closed loop can allow the handle to be securely worn around a wrist, to be secured to the handle of a baby stroller, or the like. In particular embodiments, the closed loop includes a fastener 70 adapted to allow the closed loop to be alternatively opened and closed, as representatively illustrated in FIGS. 6 and 12. Suitable fasteners include male and female snaps, hook-and-loop type mechanical fasteners, ring and eyelet pairs, and the like.

Figure 9A:
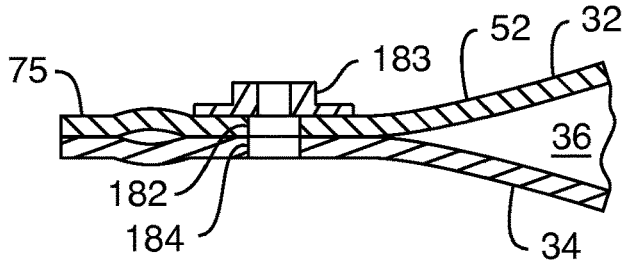
FIG. 9A is a cross-section view of the dispenser portion of FIG. 7 taken along line A-A.
Figure 9B:
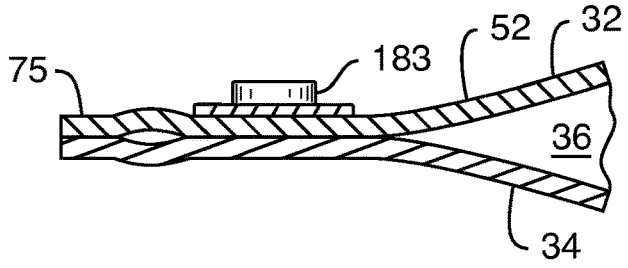
FIG. 9B is a cross-section view of the dispenser portion of FIG. 7 taken along line B-B.
Figure 10A:
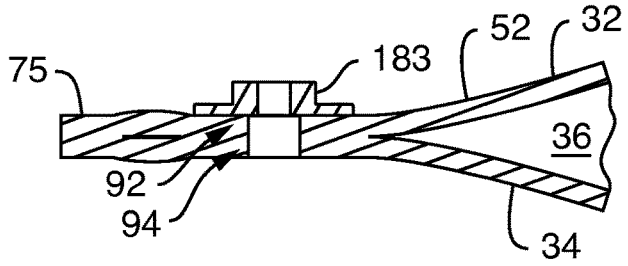
FIG. 10A is a cross-section view of an alternative embodiment of the dispenser portion of FIG. 7 taken along line A-A.
Figure 10B:
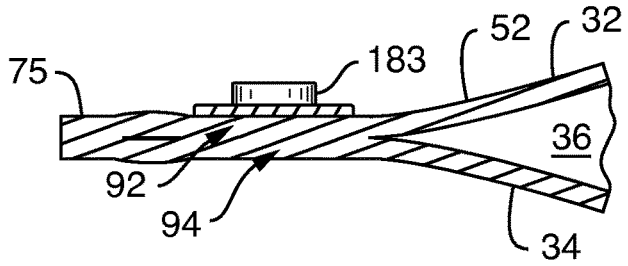
FIG. 10B is a cross-section view of an alternative embodiment of the dispenser portion of FIG. 7 taken along line B-B.
Figure 11A:
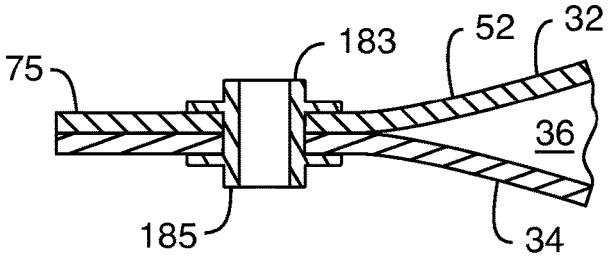
FIG. 11A is a cross-section view of another alternative embodiment of the dispenser portion of FIG. 7 taken along line A-A.
Figure 11B:
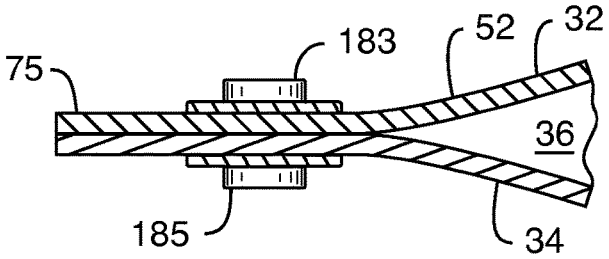
FIG. 11B is a cross-section view of another alternative embodiment of the dispenser portion of FIG. 7 taken along line B-B.

In particular embodiments, representatively illustrated in FIGS. 8 and 9, the dispenser 20 includes a front wall eyelet 182 that extends through the front wall 32 and a back wall eyelet 184 that extends through the back wall 34. The front wall eyelet 182 is superposed over the back wall eyelet 184, so as to provide at least some region of straight linear passage through the pouch 30 from the front, dispensing face of the pouch to the back, non-dispensing face of the pouch. In particular embodiments, both the front wall eyelet 182 and the back wall eyelet 184 are disposed transversely inward of the seam 60. "Transversely inward of the seam" means between the seam 60 and the bottom 29 (as opposed to between the seam 60 and the top 27). The front wall eyelet 182 has a front wall eyelet periphery 92, and the back wall eyelet 184 has a back wall eyelet periphery 94. In particular embodiments, the front wall eyelet periphery 92 is sealed to the back wall eyelet periphery 94. For example, in the embodiment representatively illustrated in FIG. 10, the front wall eyelet periphery 92 is sealed to the back wall eyelet periphery 94. Such sealing can occur with adhesive, or by melting the front wall 32 and back wall 34 together along the eyelet peripheries 92, 94 via energy, such as heat, ultrasonic, pressure, or high-frequency energy, such that the front and back walls 32, 34 become integrally fused together along the eyelet peripheries 92, 94. Sealing the front wall eyelet periphery 92 to the back wall eyelet periphery 94 can help to maximize the moisture-impervious character of the interior space 36 when the seam 60 is in the closed position 64. A flexible wet wipes pouch that has a handle or handle connector that passes directly through the interior space of the moisture-impervious pouch but that is still moisture-impervious to the outside environment (to keep the wipes from drying out) is heretofore unknown in the art.

Figure 6A:
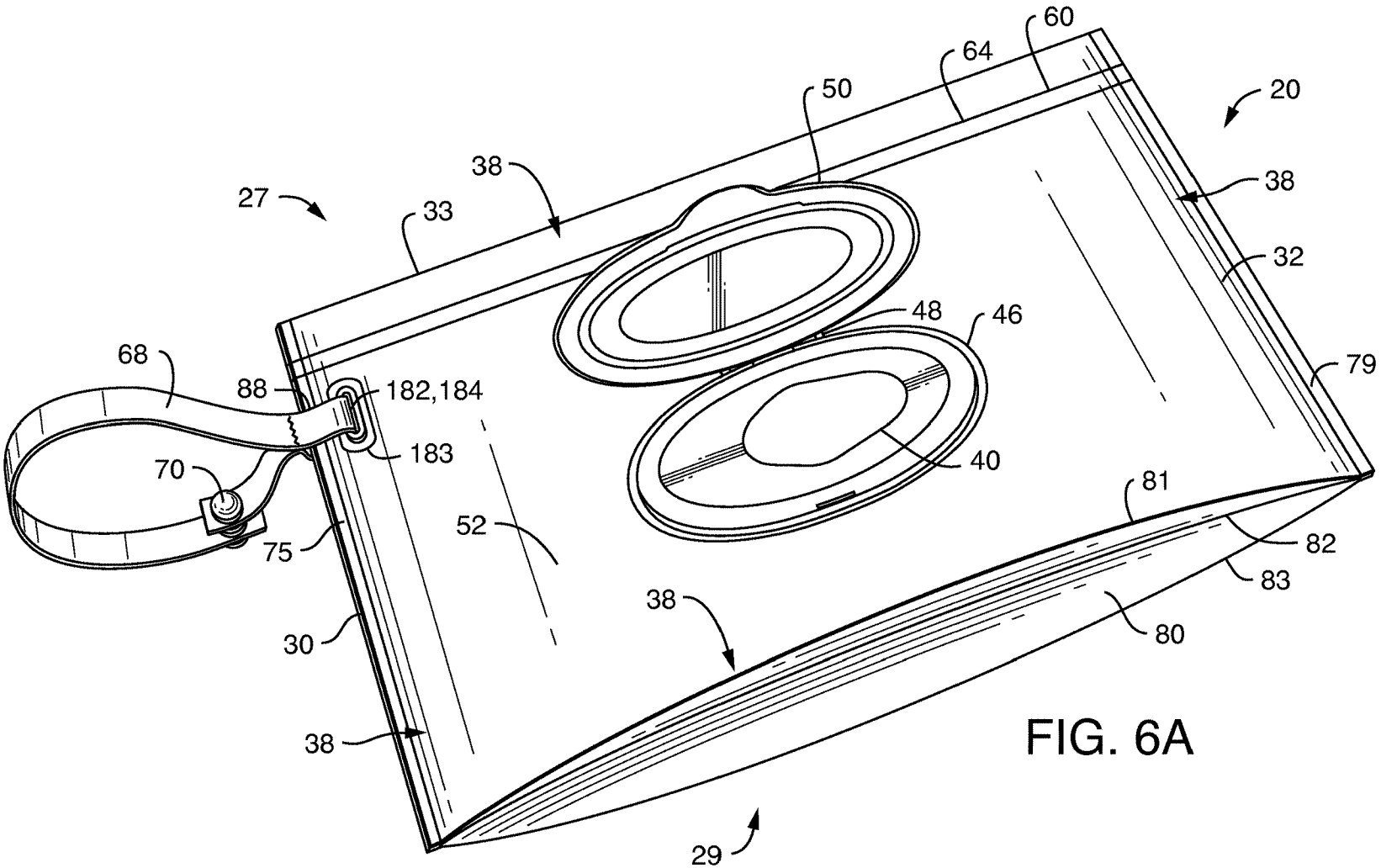
FIG. 6A is a front perspective view of one embodiment of the dispenser of the present invention.
Figure 6B:
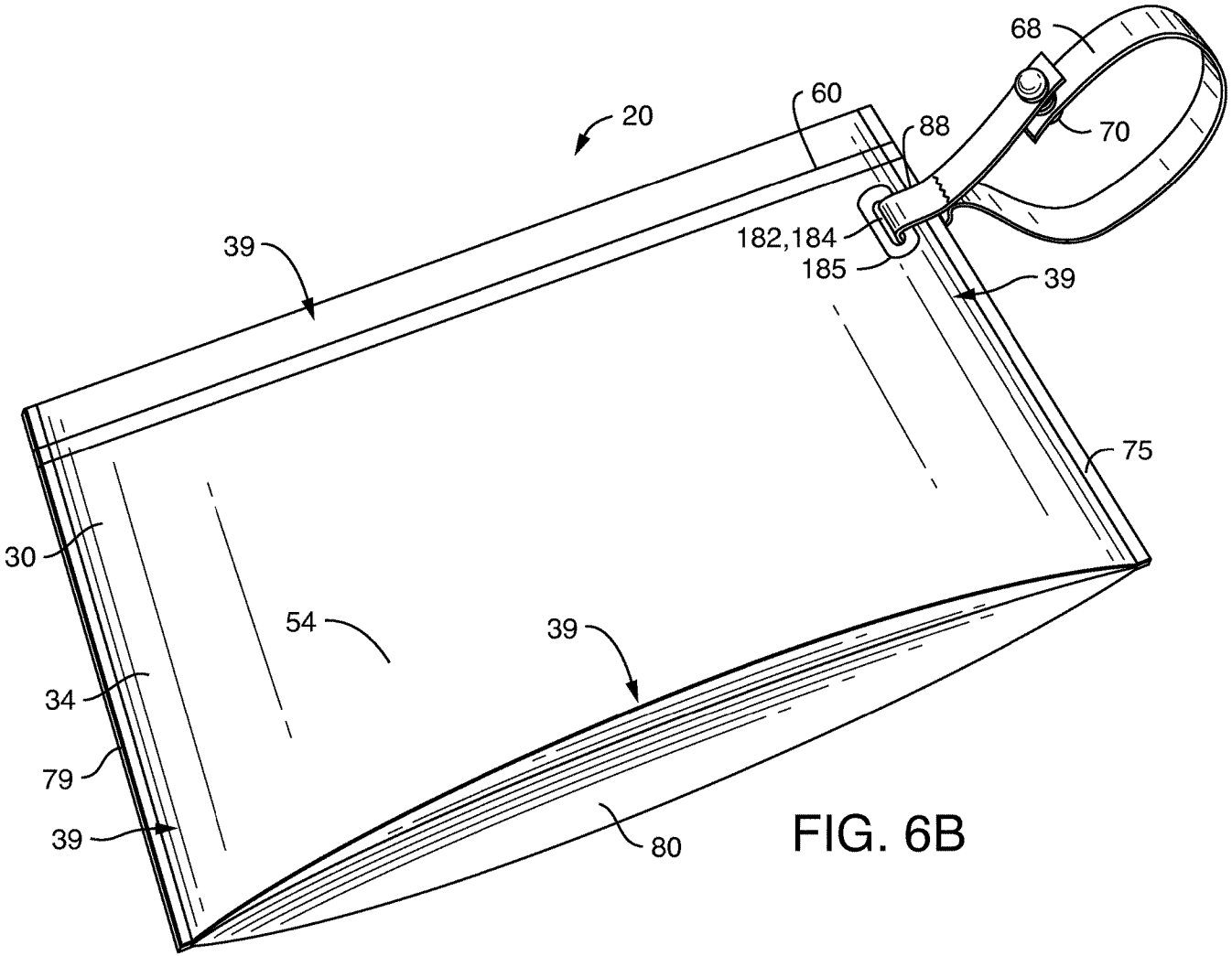
FIG. 6B is a back perspective view of the embodiment of FIG. 6A.
Figure 12:
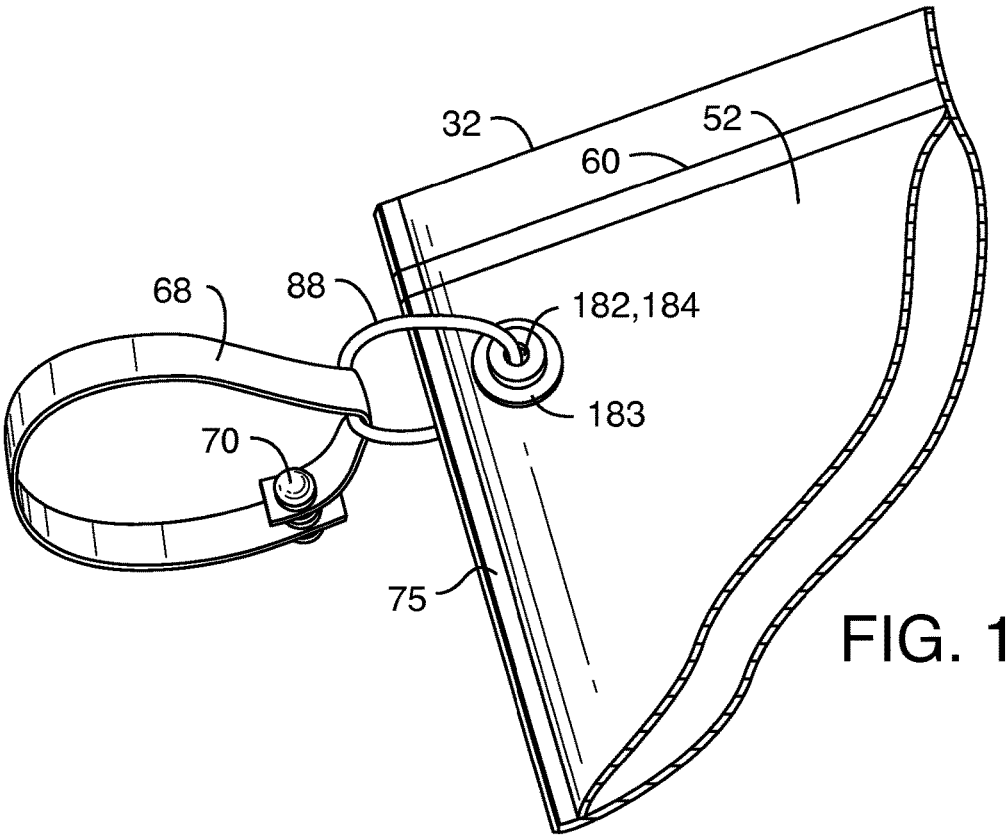
FIG. 12 is a front perspective view of a portion of an alternative embodiment of the dispenser of the present invention.

In particular embodiments, representatively illustrated in FIGS. 6 and 12, the handle 68 is connected to the pouch via a handle connector 88. The handle connector 88 extends through the front wall eyelet 182 and the back wall eyelet 184. "Handle connector" means a structure that connects the handle 68, such as a strap, to the pouch 30. In certain embodiments, the handle connector 88 is formed integrally with the handle 88. For example, as representatively illustrated in FIG. 6, the handle connector 88 is simply the portion of the strap 68 that passes through the eyelets 182, 184. In other embodiments, the handle connector 88 is formed separately from the handle 68. For example, as representatively illustrated in FIG. 12, the handle connector 88 is a ring that passes both through the eyelets 182, 184 and through the closed-loop handle 68, such that the strap handle 68 is indirectly joined to the pouch 30.

Referring to FIGS. 6-12, in particular embodiments, the dispenser 20 includes a front wall grommet 183 that surrounds the front wall eyelet 182, such as on an outer surface 52 of the front wall 32. The purpose of the grommet 183 is to reinforce or strengthen the front wall eyelet 182 to prevent the handle 68 from tearing the pouch 30 due to forces associated with carrying, hanging, or otherwise pulling on the eyelets 182,184. In particular embodiments, the dispenser includes a back wall grommet 185 that surrounds the back wall eyelet 184, such as on an outer surface 54 of the back wall 34. In some embodiments, the dispenser includes both a front wall grommet 183 and a back wall grommet 185. In one embodiment, such as that representatively illustrated in FIGS. 11A and 11B, the front wall grommet 183 and the back wall grommet 185 are integrally interconnected to each other and integrally formed with one another.

Test Procedures and Comparative Examples

Stated generally, the resistance of a material is its resistance to deflection or deformation (e.g., bending) when acted on by an applied force. The resistance of dispenser materials is herein determined with respect to a bending moment produced by a force that is directed perpendicular to the plane substantially defined by the length and width of the component being tested. As used herein, "bending resistance" means the resistance measured via a Gurley resistance test as set forth in TAPPI Standard Test T 543 om-11 (Bending Resistance of Paper (Gurley type tester)), and reported in milligrams of force. A suitable testing apparatus is a Gurley Digital Resistance Tester, model 4171-D manufactured by Teledyne Gurley, a business having offices in Troy, N.Y., U.S.A. A specimen is cut from a wipes dispenser and tested in accordance with the above-referenced TAPPI test. Although the length and width dimensions of the specimen that is cut and tested may be adjusted to accommodate the size or nature of a sample as noted in section 6 of the procedure, the force measurement for any given sample size is normalized to correspond to a 50.8 mm (2 in) by 63.5 mm (2.5 in) sample size, as set forth in TAPPI Standard Test T 543 om-11, including the use of the correct specified conversion factor depending on the test parameters used.

To contrast certain aspects of the invention from certain aspects of conventional dispensers, the bending resistance of several prototype dispenser materials as well as of a variety of commercially available dispensers were measured. For purposes of the comparative examples of Table 1, 25.4 mm×25.4 mm (1 in ×1 in) specimens were cut from a section of each flexible dispenser wall (codes 1-6 and 9-13) that was free of seams, welds, or other interfering elements. The "test length" for these codes was 12.7 mm (0.5 in). For the highly rigid, "hard case" dispensers (codes 7-8), 12.7 mm×63.5 mm (0.5 in ×2.5 in) specimens were cut from a section of each dispenser that was free of seams, corners, reinforcing flanges, or other interfering elements. The "test length" for these codes was 50.8 mm (2 inches). "Test length" means the gap from the clamp jaws to the top edge of the pendulum vane of the test apparatus. Five specimens per sample code were prepared and measured.

The orientation of the material relative to the Gurley resistance testing equipment may, for some materials, affect the measured bending resistance. This is because some materials may have microscopic structural differences in different dimensions (e.g., length versus width) stemming from certain manufacturing processes (e.g., machine direction vs. cross-machine direction). As used and claimed herein, in addition to that described above, "bending resistance" means the bending resistance of the plane of the material containing the length dimension 21 and the width dimension 23, regardless of the orientation at which the sample is cut or placed in the testing apparatus.

To contrast certain aspects of the invention from certain aspects of conventional dispensers, the thickness of several prototype dispenser materials as well as of a variety of commercially available dispensers were measured. A Thwing-Albert, Model 89-100 thickness tester (available from Thwing-Albert Instrument Co., a business having offices in West Berlin, N.J., U.S.A.) or comparable apparatus is used to measure the thickness of each material. For purposes of the comparative examples of Table 1, 3 in. by 2 in. specimens were cut from a section of each dispenser wall that was free of seams, welds, or other interfering elements. Five specimens per sample code were prepared and measured. An upper, circular pressure foot has a diameter of 28.7 mm, for an area of 645 sq. mm (1 square inch). A lower pressure foot should have a diameter equal to or larger than that of the upper pressure foot. The total dead load applied to the test specimen is 235 gm-f (~3.57 kPa). The thickness should be measured after a dwell time of approximately three (3) seconds.

Table 1 sets forth the bending resistance and thickness for various materials, and also lists the weight, mounting position, specimen size, and conversion factor used to generate the bending resistance for each material in accordance with TAPPI Standard Test T 543 om-11 as described above. Codes 1-8 are dispenser wall materials taken from commercially available wet wipes dispensers. Codes 9-13 are examples that embody principles of the present invention. Codes 9-11 are examples employing high density polyethylene films available from Berry Plastics, a business having offices in Chippewa Fall, Wis., U.S.A. Code 12 is an example of a material employing 100% ethylene vinyl acetate (EVA) material, and Code 13 is an example of a material employing 80% ethylene vinyl acetate (EVA) material and 20% polyethylene, both available from Promotion Services Group, Chicago, Ill., U.S.A.

TABLE 1

| Code | Description | Wgt (g) | Distance of wgt from pivot (in) | Width (in) | Length (in) | Conversion Factor | Mean Resistance (mgf) | Mean Thickness (mils) |
|---|---|---|---|---|---|---|---|---|
| 1 | HUGGIES ® Natural Care Soft Pack 32 ct. | 5 | 1 | 1 | 1 | 2.78 | 8.01 | 2.1 |
| 2 | Pampers ® Sensitive Soft Pack 64 ct. | 5 | 1 | 1 | 1 | 2.78 | 11.79 | 3.0 |
| 3 | Pampers ® Baby Fresh ® Soft Pack 72 ct. | 5 | 2 | 1 | 1 | 5.56 | 14.40 | 3.0 |
| 4 | Wal-Mart Parent's Choice Soft Pack - 80 ct | 5 | 2 | 1 | 1 | 5.56 | 17.63 | 1.9 |
| 5 | Walgreens Premium Baby Wipes Soft Pack | 5 | 1 | 1 | 1 | 2.78 | 8.20 | 2.5 |
| 6 | Target Up & Up Soft Pack 88 wipes | 5 | 2 | 1 | 1 | 5.56 | 19.85 | 2.3 |
| 7 | HUGGIES ® Natural Care Travel Case 16 ct | 200 | 4 | 0.5 | 2.5 | 14,222 | 41,528 | 41.6 |
| 8 | HUGGIES ® Natural Care Tub 64 ct (front panel) | 50 | 4 | 0.5 | 2.5 | 3,556 | 15,753 | 31.6 |
| 9 | 6 mil HDPE laminte | 5 | 2 | 1 | 1 | 5.56 | 21.24 | 5.8 |
| 10 | 8 mil HDPE laminate | 25 | 1 | 1 | 1 | 13.9 | 61.85 | 6.6 |
| 11 | 10 mil HDPE laminate | 25 | 2 | 1 | 1 | 27.8 | 85.90 | 9.8 |
| 12 | 100% EVA | 25 | 1 | 1 | 1 | 13.9 | 69.78 | 11.7 |
| 13 | 80% EVA/20% PEI | 25 | 2 | 1 | 1 | 27.8 | 84.79 | 10.8 |

As shown in Table 1, Codes 9-13 all having bending resistance that are greater than Codes 1-6 (conventional flexible bags for wet wipes) but that are far less than Codes 7-8 (conventional hard containers for wet wipes). Furthermore, Codes 9-13 all have thicknesses that are greater than Codes 1-6 (conventional flexible bags for wet wipes) but that are far less than Codes 7-8 (conventional hard containers for wet wipes).

It will be appreciated that details of the foregoing embodiments, given for purposes of illustration, are not to be construed as limiting the scope of this invention. Although only a few exemplary embodiments of this invention have been described in detail, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

We claim:

1. A refillable dispenser for pre-moistened wipes, the dispenser defining a length dimension and a transverse width dimension, the dispenser having a top and a bottom spaced apart in the transverse width dimension, the dispenser comprising a pouch formed from a flexible material having a bending resistance of between about 40 milligrams of force and 150 milligrams of force, the pouch having a front wall having a front wall periphery and the pouch having a back wall having a back wall periphery, the front and back walls connected to each other along their respective peripheries to define a substantially moisture impervious interior space sandwiched between the front wall and the back wall, the dispenser comprising a dispensing opening formed in the front wall, the dispenser further comprising a movable cover adapted to cover the dispensing opening, the dispenser comprising a seam that can be opened to an open position and resealed to a closed position to connect the front wall to the back wall, the open position configured to define a refill opening, the dispenser comprising a front wall eyelet extending through the front wall and a back wall eyelet extending through the back wall, the front wall eyelet superposed over the back wall eyelet, wherein both the front wall eyelet and the back wall eyelet are disposed transversely inward of the seam, the dispenser comprising a handle connected to the pouch via a handle connector, the handle connector extending through the front wall eyelet and the back wall eyelet.

2. The dispenser of claim 1 further comprising a front wall grommet surrounding the front wall eyelet on an outer surface of the front wall.

3. The dispenser of claim 2 further comprising a back wall grommet surrounding the back wall eyelet on an outer surface of the back wall.

4. The dispenser of claim 3, wherein the front wall grommet and the back wall grommet are integrally interconnected to each other.

5. The dispenser of claim 1, wherein the front wall eyelet has a front wall eyelet periphery and the back wall eyelet has a back wall eyelet periphery, wherein the front wall eyelet and back wall eyelet are integrally fused to each other along their respective peripheries.

6. The dispenser of claim 5 further comprising a front wall grommet surrounding the front wall eyelet on an outer surface of the front wall.

7. The dispenser of claim 6 further comprising a back wall grommet surrounding the back wall eyelet on an outer surface of the back wall.

8. The dispenser of claim 1, wherein the handle is a strap that defines a closed loop.

9. The dispenser of claim 7, wherein the closed loop includes a fastener adapted to allow the closed loop to be alternatively opened and closed.

10. The dispenser of claim 1, wherein the handle connector is integrally formed with the handle.

11. The dispenser of claim 1, wherein the flexible material has a thickness of between about 8 mils and about 15 mils.

12. The refillable dispenser of claim 1, wherein the dispensing opening is surrounded by a rigid ring, wherein the cover is hingedly attached to the ring.

13. The refillable dispenser of claim 1, wherein the seam comprises a press and seal seam or a sliding zipper seam.

14. The refillable dispenser of claim 1, wherein the front wall has a top edge and first and second side edges that extend perpendicularly from opposite ends of the front wall top edge, and wherein the back wall has a top edge and first and second side edges that extend perpendicularly from opposite ends of the back wall top edge.

15. The refillable dispenser of claim 14, wherein the front wall is connected to the back wall via a first side seam that connects the front wall first side edge to the back wall first side edge, via a second side seam that connects the front wall second side edge to the back wall second side edge, and via a bottom gusset wall that extends between and is formed integrally with the front wall and the back wall, further wherein both the front wall eyelet and the back wall eyelet are disposed between the first side seam and the second side seam.

16. The refillable dispenser of claim 1, wherein the dispenser further includes a stack of pre-moistened wipes.

17. A refillable dispenser for pre-moistened wipes, the dispenser defining a length dimension and a transverse width dimension, the dispenser having a top and a bottom spaced apart in the transverse width dimension, the dispenser comprising a pouch formed from a flexible material having a bending resistance of between about 40 milligrams of force and 150 milligrams of force, and a thickness of between about 8 mils and about 15 mils, the pouch having a front wall having a front wall periphery and the pouch having a back wall having a back wall periphery, the front and back walls connected to each other along their respective peripheries to define a substantially moisture impervious interior space sandwiched between the front wall and the back wall, the dispenser comprising a dispensing opening formed in the front wall, the dispenser further comprising a movable cover adapted to cover the dispensing opening, the dispenser comprising a seam that can be opened to an open position and resealed to a closed position to connect the front wall to the back wall, the open position configured to define a refill opening, the dispenser comprising a front wall eyelet extending through the front wall and a back wall eyelet extending through the back wall, the front wall eyelet superposed over the back wall eyelet, wherein both the front wall eyelet and the back wall eyelet are disposed transversely inward of the seam, the dispenser comprising a handle connected to the pouch via a handle connector, the handle connector extending through the front wall eyelet and the back wall eyelet, the handle defining a closed loop, wherein the handle connector is integrally formed with the handle, wherein the front wall eyelet has a front wall eyelet periphery and the back wall eyelet has a back wall eyelet periphery, wherein the front wall eyelet and back wall eyelet are integrally fused to each other along their respective peripheries, wherein a front wall grommet surrounds the front wall eyelet on an outer surface of the front wall, wherein the dispensing opening is surrounded by a rigid ring, wherein the cover is hingedly attached to the ring, wherein the seam comprises a press and seal seam or a sliding zipper seam, wherein the front wall has a top edge and first and second side edges that extend perpendicularly from opposite ends of the front wall top edge, and wherein the back wall has a top edge and first and second side edges that extend perpendicularly from opposite ends of the back wall top edge, where the front wall is connected to the back wall via a first side seam that connects the front wall first side edge to the back wall first side edge, via a second side seam that connects the front wall second side edge to the back wall second side edge, and via a bottom gusset wall that extends between and is formed integrally with the front wall and the back wall, wherein both the front wall eyelet and the back wall eyelet are disposed between the first side seam and the back side seam of the seam.

18. The dispenser of claim 17, wherein the dispenser includes a stack of pre-moistened wipes.

* * * * *